US010273042B1

(12) United States Patent
Kolodziey

(10) Patent No.: US 10,273,042 B1
(45) Date of Patent: Apr. 30, 2019

(54) BI-DIRECTIONAL CARTON OPENING SYSTEM

(71) Applicant: Wayne Automation Corporation, Norristown, PA (US)

(72) Inventor: John Kolodziey, Philadelphia, PA (US)

(73) Assignee: WAYNE AUTOMATION CORPORATION, Norristown, PA (US)

( * ) Notice: Subject to any disclaimer, the term of this patent is extended or adjusted under 35 U.S.C. 154(b) by 155 days.

(21) Appl. No.: 15/654,036

(22) Filed: Jul. 19, 2017

(51) Int. Cl.

| | |
|---|---|
| ***B65B 43/26*** | (2006.01) |
| ***B65B 43/30*** | (2006.01) |
| ***B65B 43/32*** | (2006.01) |
| ***B65D 5/54*** | (2006.01) |
| ***B65B 43/39*** | (2006.01) |
| ***B31B 50/52*** | (2017.01) |
| *B65D 71/00* | (2006.01) |
| *B65D 85/00* | (2006.01) |
| *B65B 43/28* | (2006.01) |

(52) U.S. Cl.
CPC ..... *B65D 5/54* (2013.01); *B31B 50/52* (2017.08); *B65B 43/39* (2013.01); *B65B 43/265* (2013.01); *B65B 43/285* (2013.01); *B65B 43/305* (2013.01); *B65B 43/325* (2013.01); *B65D 71/00* (2013.01); *B65D 85/00* (2013.01)

(58) Field of Classification Search
CPC ... B65B 43/265; B65B 43/285; B65B 43/305; B65B 43/325
USPC ..... 493/309, 313; 53/381.1, 458
See application file for complete search history.

(56) References Cited

U.S. PATENT DOCUMENTS

| | | | | |
|---|---|---|---|---|
| 5,689,931 | A * | 11/1997 | Bridges | B65B 43/285 493/309 |
| 6,240,707 | B1 * | 6/2001 | Ford | B65B 43/305 493/315 |
| 6,915,622 | B2 * | 7/2005 | Spatafora | B65B 5/06 53/458 |
| 8,075,467 | B2 * | 12/2011 | Monti | B65B 43/28 493/177 |
| 8,181,427 | B2 * | 5/2012 | Kobierzycki | B65B 43/305 53/376.7 |
| 9,090,038 | B1 * | 7/2015 | Bachman, Jr. | B31B 19/90 |
| 9,533,785 | B2 * | 1/2017 | Rapp | B65B 43/145 |
| 2009/0093355 | A1 * | 4/2009 | Huang | B65B 43/265 493/309 |
| 2012/0122646 | A1 * | 5/2012 | Murano | B65B 43/305 493/309 |

(Continued)

FOREIGN PATENT DOCUMENTS

| | | | | |
|---|---|---|---|---|
| DE | 102017200507 | A1 * | 7/2018 | B31B 50/76 |
| EP | 0734952 | A1 * | 10/1996 | B65B 43/305 |

*Primary Examiner* — Justin M Larson
(74) *Attorney, Agent, or Firm* — Michael R. Philips

(57) ABSTRACT

A bi-directional carton opening system for opening cartons in left hand or right hand configuration. The system utilizes apparatus having a Y axis rail with a first X axis rail fixedly mounted thereto and a second X axis rail mounted moveably thereto. A carton is gripped by a carrier on the first X axis rail and a carrier on the second X axis rail. The carrier on one of the X axis rails is moved along the respective X axis rail while the carrier on the other X axis rail is held in place and the moveable X axis rail is moved along the Y axis to open the carton to a rectangular tubular shape.

10 Claims, 4 Drawing Sheets

(56) References Cited

U.S. PATENT DOCUMENTS

2013/0040795 A1* 2/2013 Murano ..... B31B 50/00
493/53
2018/0072444 A1* 3/2018 Webb ..... B65B 43/185

* cited by examiner

BI-DIRECTIONAL CARTON OPENING SYSTEM

FIELD OF THE INVENTION

The present invention relates to the field of carton opening systems, and more particularly to a carton opening system that is capable of adapting to opening a flat carton in either right hand or left hand configuration.

BACKGROUND OF THE INVENTION

Cartons used for packaging products for storage or for shipment are typically made of corrugated board that has been die cut, scored, and glued to form a flat carton. A quantity of flat cartons are stacked and delivered to a production packaging line where the individual cartons are expanded from the flat condition to a rectangular tubular condition. The flaps on one end of the opened tubular carton are folded inward to close the bottom of the carton while the flaps on the top of the opened tubular carton remain unfolded.

While some cartons have equal sized side and end panels so as to become a square shape when opened, most cartons are unequal rectangles with two long side panels and two short end panels, the long side panels being in relatively opposing positions and the short end panels being in relatively opposing positions. When a stack of cartons is positioned at the production packaging line, the cartons are oriented with a set of flaps facing up and the opposite set of flaps facing down prior to opening the cartons for filling. As viewing a vertically oriented flat carton in side elevation, if the long side panel is to be moved to the left in order to open the carton, it is a left hand carton. Conversely, if the long side panel is to be moved to the right in order to open the carton, the carton is a right hand carton.

Numerous machine systems have been developed to open flat cartons into tubular shape. However, the known equipment for this opening process is basically for opening either left hand cartons or right hand cartons. Maintaining the left hand or right hand positioning of cartons is important because the printing on the carton panels must be properly oriented. Some of the present carton opening machines may be mechanically adjusted, e.g. by changing a gear or pulley, to change the configuration of the carton that will be formed from flat into tubular shape. Mechanical adjustment necessarily requires time and adds cost. Therefore, a need exists for a carton opening system able to be switched quickly from a left hand opening condition to a right hand opening condition.

SUMMARY OF THE INVENTION

The invention disclosed herein provides a system for opening left hand cartons or right hand cartons without requiring mechanical modification, the left hand and right hand capability defining the bi-directional facility of the invention system. The equipment employed has a fixed Y axis rail with two X axis rails connected thereto, a first X axis rail being fixed in position on the Y axis rail and a second X axis rail being moveable along the Y axis rail. A carton carrier is mounted to each of the X axis rails to be moveable along the length thereof. Each carton carrier has a carton gripper able to securely hold a panel of the carton as the carton carrier is moved along the respective rail. The moveable X axis rail is moved along the Y axis rail in coordination with the carton carriers being moved along the X axis rails to cause the carton to be opened to a rectangular tubular shape. When a left hand carton is being opened, the carton carrier on the fixed X axis rail remains at a position distal from the Y axis rail and the carton carrier on the moveable X axis rail is moved from being distal from the Y axis rail to being proximal thereto. When a right hand carton is being opened, the carton carrier on the fixed X axis rail moves from a position distal from the Y axis rail to a position proximal to the Y axis rail and the carton carrier on the moveable X axis rail remains proximal to the Y axis rail. The resultant opened rectangular tube in each left hand and right hand case is located similarly proximal to the Y axis rail to avoid the need to compensate for carton positioning to accommodate the subsequent operations of sealing and filling the carton.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENTS

Figure 1A:
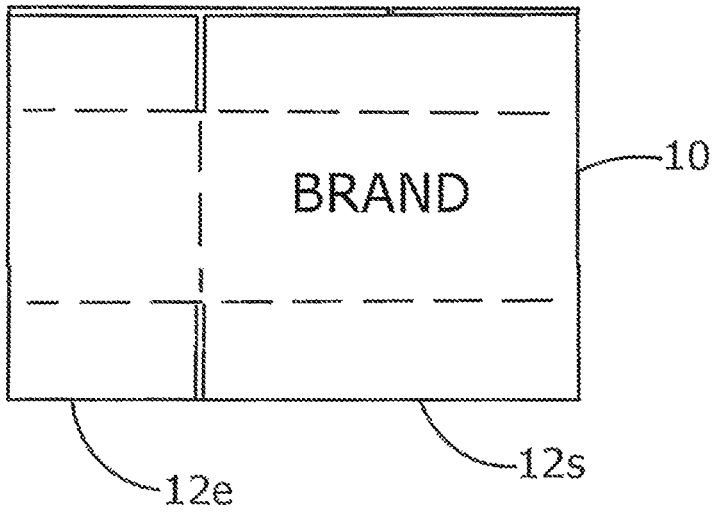
FIGS. 1A, 1B, and 1C show a left hand carton in front perspective view undergoing the transition from a flat carton to an open tubular container with the bottom flaps folded.

Referring to FIG. 1A, a flat left hand carton 10 is seen in front perspective view. The printed word "BRAND" is used to clearly indicate the upright orientation of carton 10. As defined above, the required movement of the long side panel to the left to open carton 10 identifies carton 10 as a left hand carton. A long bottom side flap 12*s* and a short bottom end flap 12*e* will be folded into horizontal position after carton 10 is fully opened to a rectangular tubular form. A mirror image pair of bottom flaps (not seen) exists on the rear side of carton 10. The top flaps, not numbered, will be retained in open condition until carton 10 has been filled.

Figure 1B:
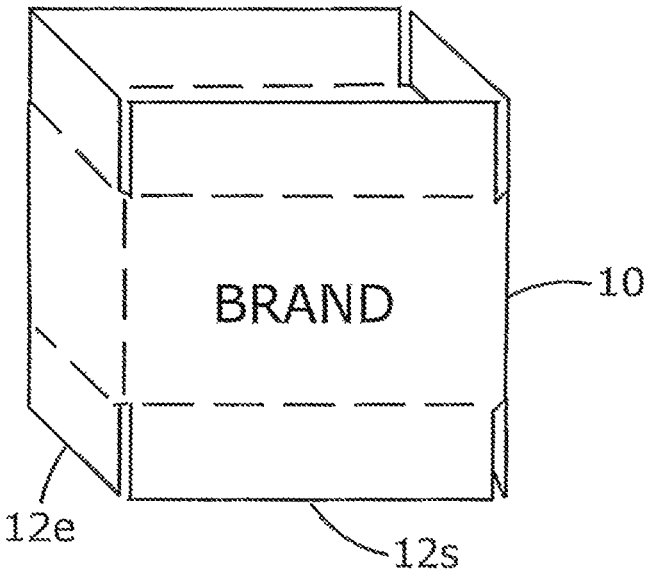

Referring now to FIG. 1B, left hand carton 10 described above has been opened to a rectangular tubular form. Long bottom side flap 12*s* and short bottom end flap 12*e* remain in downwardly extended condition.

Figure 1C:
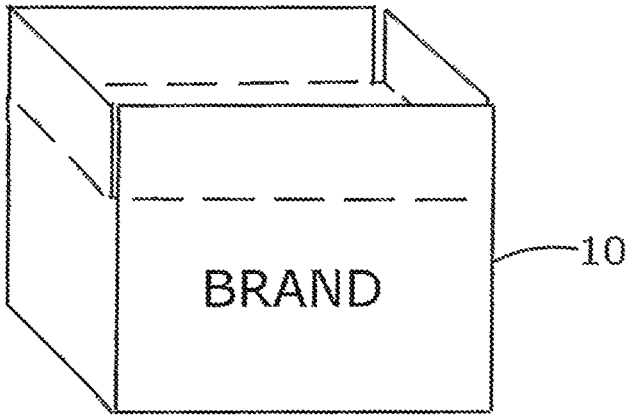

Referring now to FIG. 1C, left hand carton 10 has undergone full opening with the long bottom side flaps and the short bottom end flaps discussed above having been folded to be in a substantially common horizontal plane, as is known.

Figure 2A:
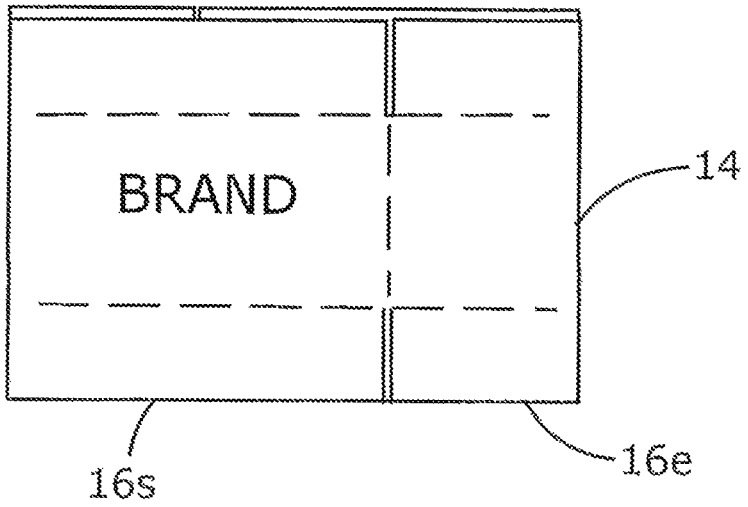
FIGS. 2A, 2B, and 2C show a right hand carton in front perspective view undergoing the transition from a flat carton to an open tubular container with the bottom flaps folded.

Referring now to FIG. 2A, a flat right hand carton 14 is seen in front perspective view. The significant difference from carton 10 seen in FIGS. 1A, 1B, and 1C is that the long front panel of right hand carton 14 is on the left to require being moved to the right when carton 14 is opened. A long bottom side flap 16*s* and a short bottom end flap 16*e* will be folded into horizontal position after carton 14 is fully opened to a rectangular tubular form. A mirror image pair of bottom flaps (not seen) exists on the rear side of carton 14. The top flaps, not numbered, will be retained in open condition until carton 14 has been filled.

Figure 2B:
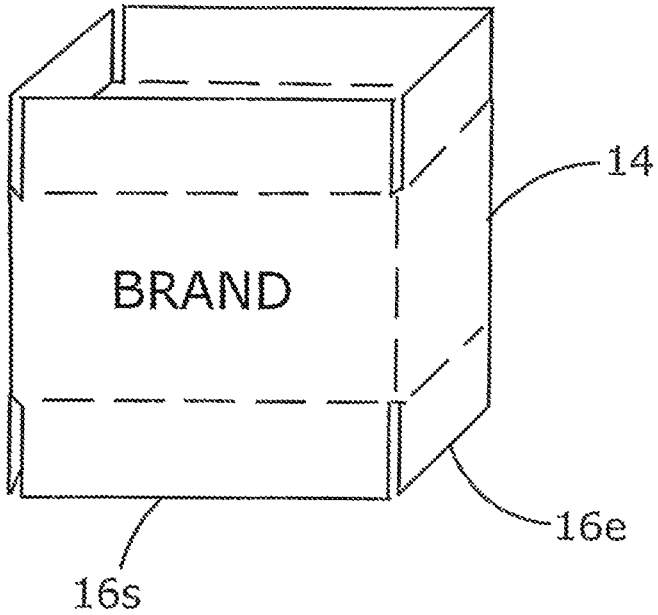

Referring now to FIG. 2B, right hand carton 14 has been opened to a rectangular tubular form. Long bottom side flap 16*s* and short bottom end flap 16*e* remain downwardly extended.

Figure 2C:
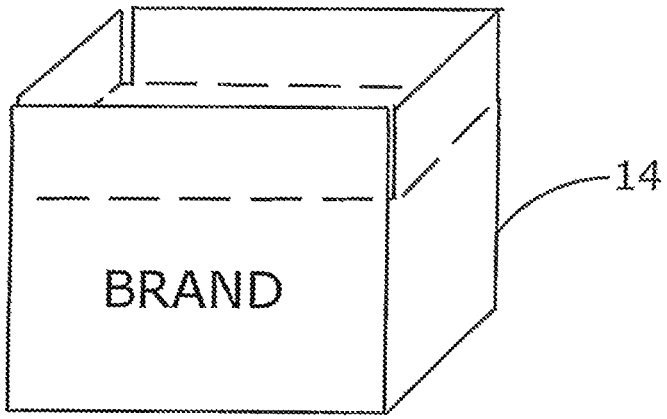

Referring now to FIG. 2C, right hand carton 14 has undergone full opening with the long bottom side flaps and the short bottom end flaps folded to be substantially horizontally coplanar.

As is common in the industry, a supply of flat cartons (not shown) is positioned near or at the equipment for opening cartons from the flat condition to a rectangular tubular condition. A transporter is activated to move each flat carton in sequence from the supply station to the opening equipment. The following drawing figures show the equipment of the invention bi-directional carton opening system in schematic top plan view. According to the following description, the bi-directional carton opening system is capable of being switched from opening left hand cartons to opening right hand cartons without the requirement for mechanically modifying the equipment employed.

Figure 3:
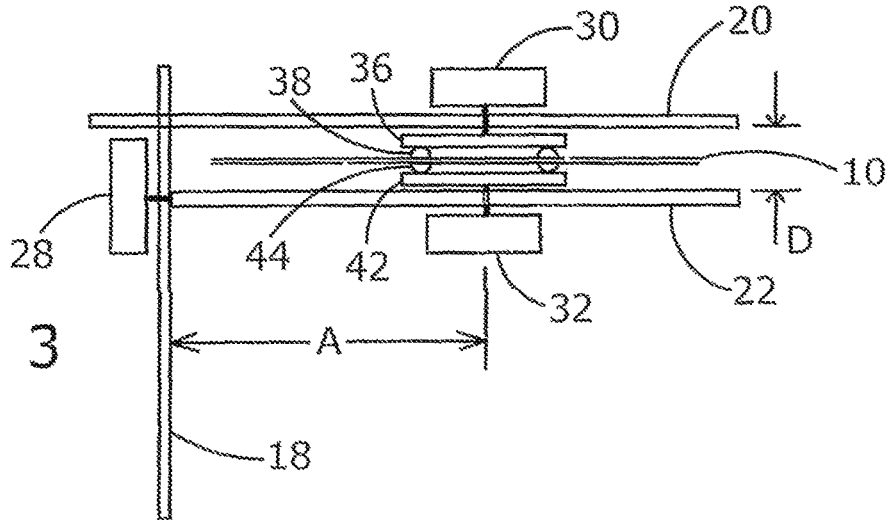
FIG. 3 is a schematic top plan view of the bi-directional carton opening system of the present invention with a flat left hand carton in position for opening.

Referring now to FIG. 3, the bi-directional carton opening equipment comprises a Y axis rail 18 to which a first X axis rail 20 is assembled in fixed perpendicular relation. A second X axis rail 22 is assembled to Y axis rail 18 in perpendicular relation in a manner to allow motion along Y axis rail 18. A Y axis drive 28 is connected to move X axis rail 22 along Y axis rail 18. A first X axis carrier 36 is assembled to first X axis rail 20 in moveable relation along X axis rail 20. A plurality of grippers 38 is mounted to X axis carrier 36, grippers 38 being adapted for holding securely to a carton panel during opening operations. A first X axis drive 30 is connected in a manner to move X axis carrier 36 along X axis rail 20. A second X axis carrier 42 is assembled to second X axis rail 22 in moveable relation along X axis rail 22. A plurality of grippers 44 is mounted to second X axis carrier 42, grippers 44 being adapted for holding securely to a carton panel during opening operations. A second X axis drive 32 is connected in a manner to move X axis carrier 42 along X axis rail 22.

Referring further to FIG. 3, grippers 38 and grippers 44 are preferably vacuum activated grip units, e.g. suction cups. Y axis driver 28, first X axis driver 30 and second X axis driver 32 may be any known linear motion device, including a pulley and belt drive with a servo motor, a linear motor drive, a pneumatic cylinder drive, etc. Drives 28, 30, 32 and a controllable vacuum source connected to grippers 38, 44 are controlled by a microprocessor unit (not shown). The microprocessor is first set to open either a left hand carton or a right hand carton, in addition to being set to accommodate the dimensions and geometry of the cartons to be opened. Setting these parameters is accomplished by a manual control switch or by inputting a carton identification code through a user interface, e.g. a keyboard. Alternatively, the carton identification code may be set in response to reading a bar code or other pattern printed on the carton. The carton identification code defines a particular carton configuration by carton dimensions and left hand or right hand orientation. In a particular embodiment of the invention, flat cartons varying in size from 10×12 inches to 38×44 inches are readily handled. Alternate embodiments of the invention may accommodate a different range of flat carton dimensions.

Continuing with FIG. 3, once the parameters of the carton size and geometry are set, the first process step for a left hand carton is to move a flat left hand carton 10 from a supply station (not shown) and insert the carton between grippers 38 and 44 to be engaged thereby through the activation of a vacuum source (not shown). In the case of a left hand carton as described, first X axis carrier 36 and second X axis carrier 42 are similarly positioned at a distance A, distal from Y axis rail 18. With carton 10 in flat condition, second X axis rail 22 is positioned a distance D from first X axis rail 20.

Figure 4:
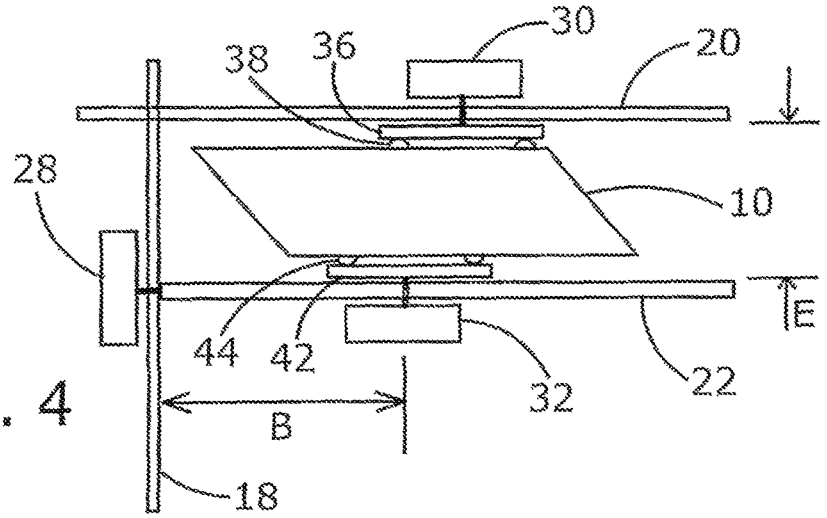
FIG. 4 is the system of FIG. 3 with the left hand carton partially opened.

Referring now to FIG. 4, carton 10 is shown as partly opened from the flat condition. The process for opening involves holding first X axis carrier 36 fixed in the position shown in FIG. 3 while Y axis driver 28 moves second X axis rail 22 away from first X axis rail 20 and simultaneously second X axis driver 32 moves second X axis carrier 42 toward Y axis rail 18. As illustrated, second X axis rail 22 is now a distance E from first X axis rail 20 and second X axis carrier 42 is a distance B from Y axis 18. Distance E is somewhat greater than distance D of FIG. 3 and distance B is somewhat less than distance A of FIG. 3. The coordinated motion of Y axis driver 28 and second X axis driver 32 is controlled by the microprocessor in accordance with established parameters relating to the size and geometry of the carton being opened.

Figure 5:
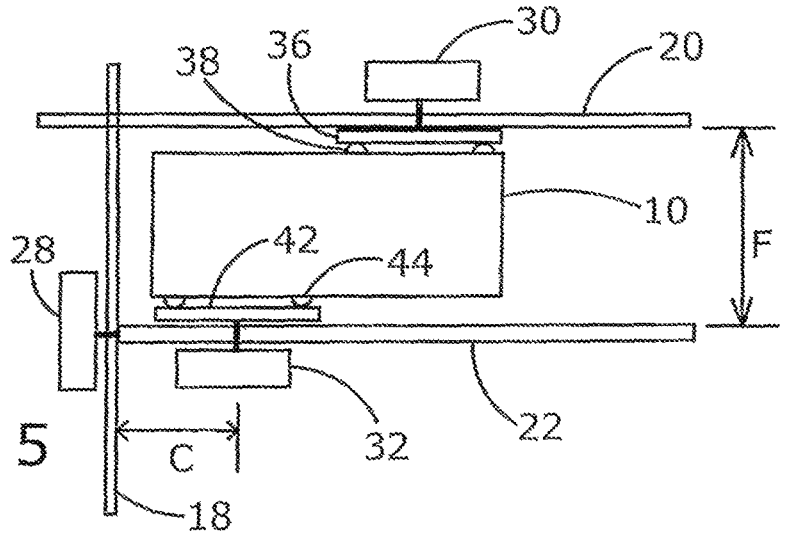
FIG. 5 is the system of FIG. 4 with the left hand carton fully opened.

Referring now to FIG. 5, carton 10 has been fully opened to a rectangular tube shape as seen in top plan view. First X axis carrier 36 remains in the position of FIG. 3 and FIG. 4 while second X axis carrier 42 has moved closer to Y axis rail 18 and second X axis rail 22 has moved farther from first X axis rail 20. As illustrated, second X axis rail 22 now resides a distance F from first X axis rail 20 and second X axis carrier 42 resides a distance C from Y axis rail 18. Distance F is somewhat greater than distance E of FIG. 4 and distance C is somewhat less than distance B of FIG. 4. As will be understood, the motion of second X axis carrier 42 along X axis rail 22 and the motion of second X axis rail 22 along Y axis rail 18 follows a curved path determined by the relative length of the long side panel in comparison to the length of the short end panel of left hand carton 10. A mechanism engages and folds the bottom minor flaps 12*s*, 12*e* (see FIGS. 1A, 1B) upward and carton 10 is transferred to a conveyor having a station for closing and sealing the bottom major flaps. Typically, a separate machine is then used to fill carton 10 with product.

Figure 6:
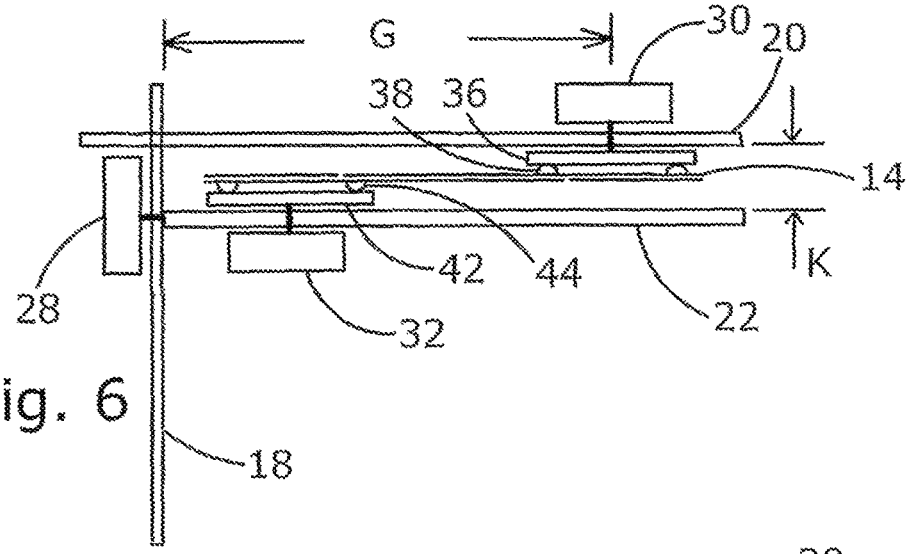
FIG. 6 is the system of FIG. 3 with a flat right hand carton in position for opening.

Referring now to FIG. 6, the system for bi-directional carton opening is illustrated in top plan view as applied to a right hand carton 14. For right hand carton 14, first X axis carrier 36 is positioned distal from Y axis rail 18 and second X axis carrier 42 is positioned proximal to Y axis rail 18. Y axis rail 18, fixed X axis rail 20, and moveable second X axis rail 22 are as described above with Y axis driver 28 connected to second X axis rail 22. First X axis carrier 36 is positioned a distance G from Y axis rail 18. Second X axis carrier 42 is positioned proximal to Y axis rail 18. Carriers 36 and 42 are each fitted with a plurality of vacuum operated grippers 38, 44 as described above. Second X axis rail 22 is positioned a distance K from first X axis rail 20. The pertinent carton identification code has been communicated to the microprocessor by operator input or a code reading facility to appropriately control the start position and the movements of linear actuators 30, 32. A flat right hand carton 14 has been placed with each long side panel of carton 14 positioned to be held securely by respective first grippers 38 and second grippers 44.

Figure 7:
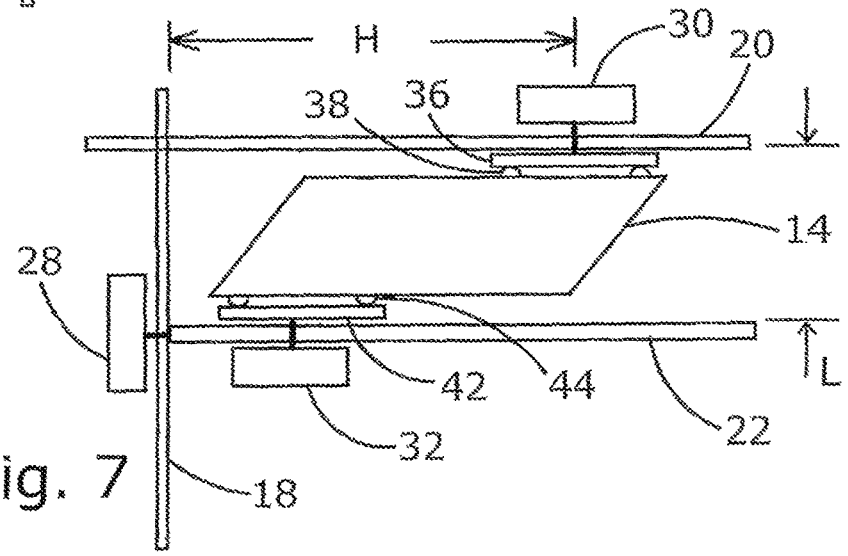
FIG. 7 is the system of FIG. 6 with the right hand carton partially opened.

Referring now FIG. 7, the process of opening right hand carton 14 has begun. Second X axis carrier 42 remains as positioned in FIG. 6 above while second X axis rail 22 has been moved to a distance L from first X axis rail 20. First X axis carrier 36 has been moved to a distance H from Y axis rail 18. Distance L is somewhat greater than distance K of FIG. 6 and distance H is somewhat less than distance G of FIG. 6.

Figure 8:
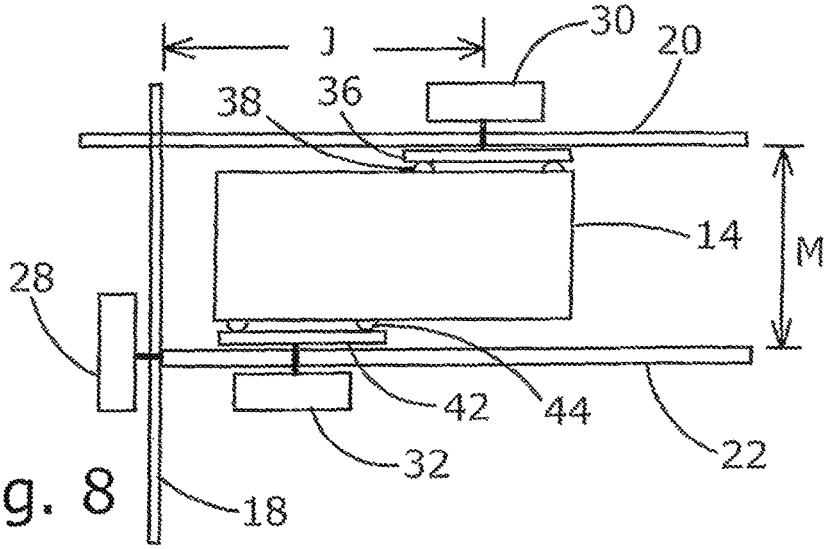
FIG. 8 is the system of FIG. 7 with the right hand carton fully opened.

Referring now to FIG. 8, the process of opening right hand carton 14 to a rectangular tubular shape is complete. Second X axis rail 22 has been moved to reside a distance M from first X axis rail 20. First X axis carrier 36 has been moved to reside a distance J from Y axis rail 18. Distance M is somewhat greater than distance L of FIG. 7 and distance J is somewhat less than distance H of FIG. 7. Second X axis carrier 42 remains in the position shown in FIG. 6 above, to be proximal to Y axis rail 18. A mechanism engages and folds the bottom minor flaps upward and carton 14 is transferred to a conveyor having a station for closing and sealing the bottom major flaps. Typically, a separate machine is then used to fill carton 10 with product.

As described above, the bi-directional carton opening system of the invention is capable of handling left hand cartons and right hand cartons differently without the need for mechanical modification. When a left hand carton is to be opened as illustrated in FIGS. 3, 4 and 5, first X axis carrier 36 remains stationary in a position distal from Y axis rail 18 while second X axis rail 22 moves away from first X axis rail 20 and second X axis carrier 42 moves closer to Y axis rail 18. Alternatively, when a right hand carton is to be opened as illustrated in FIGS. 6, 7 and 8, second X axis carrier 42 remains stationary in a position proximal to Y axis rail 18 while second X axis rail 22 moves away from first X axis rail 20 and first X axis carrier 36 moves closer to Y axis rail 18.

Therefore, as described in detail above, utilizing the bi-directional carton opening system of the invention having a Y axis rail, a fixed X axis rail and a moveable X axis rail, consists of:

1. transmitting to a microprocessor information regarding the size and configuration of the carton to be opened;
2. positioning carton carriers at a point along each respective X axis rail for receiving a flat carton for being opened;
3. inserting a flat carton from a carton supply to be engaged by grippers of the carton carriers;
4. activating the grippers on each carrier for securely holding the flat carton; and
5. moving one of the carton carriers in a selected direction while moving the moveable X axis rail in a second selected direction for opening the flat carton.

While the description above discloses preferred embodiments of the present invention, it is contemplated that numerous variations and modifications of the invention are possible and are considered to be within the scope of the claims that follow.

What is claimed is:

1. A bi-directional carton opening system, comprising the steps of:

a. providing a carton opening apparatus having a Y axis rail with a fixed X axis rail and a moveable X axis rail mounted thereto, each X axis rail having a moveable carton carrier with a gripper mounted thereto;
b. placing a flat carton from a supply station to a position for engagement by both the carton carrier mounted on the fixed X axis rail and the carton carrier mounted on the moveable X axis rail;
c. activating the grippers on the two carton carriers to securely grip the flat carton;
d. maintaining a first one of the carton carriers fixed in position;
e. moving a second one of the carton carriers along one of the X axis rails; and
f. moving the moveable X axis rail along the Y axis rail;
g. wherein the flat carton is opened to a rectangular tubular shape.

2. The bi-directional carton opening system of claim 1, further comprising providing a first driver for moving the moveable X axis rail along the Y axis rail.

3. The bi-directional carton opening system of claim 1, further comprising providing a second driver for moving the carton carrier on the fixed X axis rail along the fixed X axis rail.

4. The bi-directional carton opening system of claim 1, further comprising providing a third driver for moving the carton carrier on the moveable X axis rail along the moveable X axis rail.

5. The bi-directional carton opening system of claim 1, after opening the carton to a rectangular tubular shape, further comprising the step of closing bottom flaps of the carton and moving the carton to be filled with product.

6. The bi-directional carton opening system of claim 1, further comprising the step of providing information to a system microprocessor, the information defining the dimensions and configuration of the carton to be opened.

7. The bi-directional carton opening system of claim 6, further comprising the step of causing the carton carrier on the fixed X axis rail to remain fixed in position and moving the carton carrier on the moveable X axis rail along the moveable X axis rail when the information indicates a left hand carton configuration.

8. The bi-directional carton opening system of claim 6, further comprising the step of causing the carton carrier on the moveable X axis rail to remain fixed in position and moving the carton carrier on the fixed X axis rail along the fixed X axis rail when the information indicates a right hand carton configuration.

9. The bi-directional carton opening system of claim 7, wherein the carton carrier on the fixed X axis rail remains fixed in a position distal from the Y axis rail.

10. The bi-directional carton opening system of claim 8, wherein the carton carrier on the moveable X axis rail remains fixed in a position proximal to the Y axis rail.

* * * * *